US006195831B1

(12) United States Patent
Devaney et al.

(10) Patent No.: US 6,195,831 B1
(45) Date of Patent: Mar. 6, 2001

(54) DISPLAY SCREEN CLEANING TOOL

(76) Inventors: Thomas W. Devaney, 2219 W. Olive, Suite #148, Burbank, CA (US) 91506; Stephen M. Plakcy, 11900 Goshen Ave., Suite #104, Los Angeles, CA (US) 90049

( * ) Notice: Subject to any disclaimer, the term of this patent is extended or adjusted under 35 U.S.C. 154(b) by 0 days.

(21) Appl. No.: 09/185,994

(22) Filed: Nov. 4, 1998

(51) Int. Cl.[7] ..... A47L 25/00

(52) U.S. Cl. ..... 15/209.1; 15/118; 15/210.1; 15/227; D32/43

(58) Field of Search ..... 15/118, 209.1, 15/210.1, 220.1, 104.94, 229.14, 227, 208, 214; D32/43; D28/63

(56) References Cited

U.S. PATENT DOCUMENTS

D. 170,734 * 10/1953 Wright .
1,681,031 * 8/1928 Forbis .
2,117,962 * 5/1938 Johnson .
2,756,448 * 7/1956 Werbe .
5,000,204 * 3/1991 Smith .
5,074,249 * 12/1991 McMahon .
5,201,093 4/1993 Wells et al. .
5,280,661 * 1/1994 Brown .
5,344,002 * 9/1994 Baczkowski .
5,647,786 7/1997 Caspescha .
5,657,507 8/1997 Wojciech .
5,687,445 11/1997 Hocking .
5,694,659 * 12/1997 Merrion .
5,746,639 5/1998 Bloom et al. .
5,915,434 * 6/1999 Juarez .

OTHER PUBLICATIONS

Product Brochure: Hutchings & Harding LDT date unknown.
SGS Certificate of Inspection Mar. 31, 1998.

* cited by examiner

*Primary Examiner*—Deborah Jones
*Assistant Examiner*—Jennifer McNeil
(74) *Attorney, Agent, or Firm*—Robert A. Pajak

(57) ABSTRACT

An optical grade chamois like fabric is employed as a display screen cleaning tool. In one embodiment of the invention, an optical grade chamois like fabric is utilized, at least in part, to form a body having an inner chamber capable of being filled with a stuffing material so as to form a three dimensional figure, and an outer surface for wiping the display screen. In another embodiment of the invention, the display screen cleaning tool is embodied in a pocket style configuration for permitting the insertion of fingers therein to facilitate the cleaning tool.

14 Claims, 2 Drawing Sheets

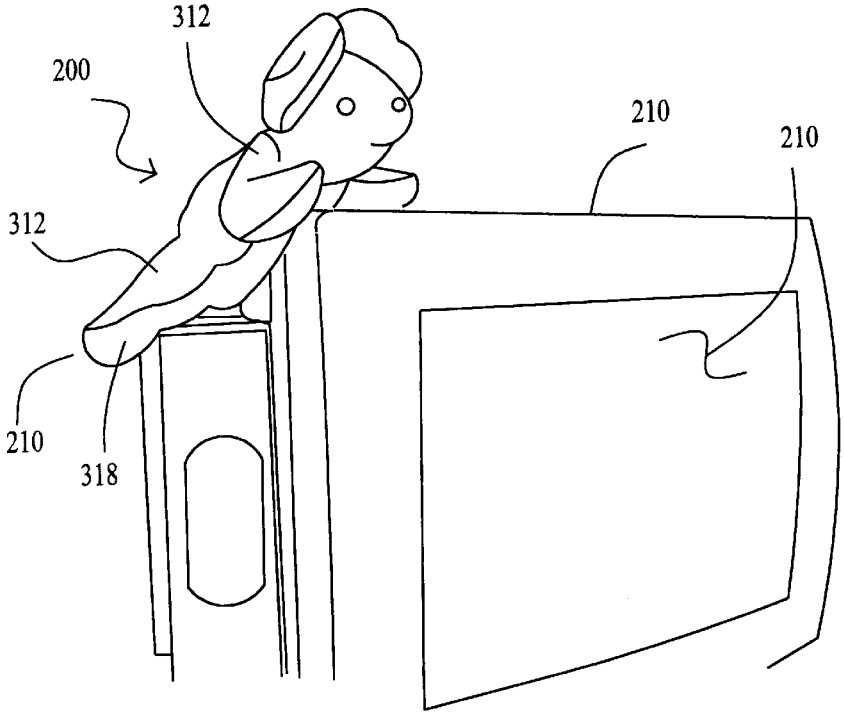
FIG. 2
FIG. 3
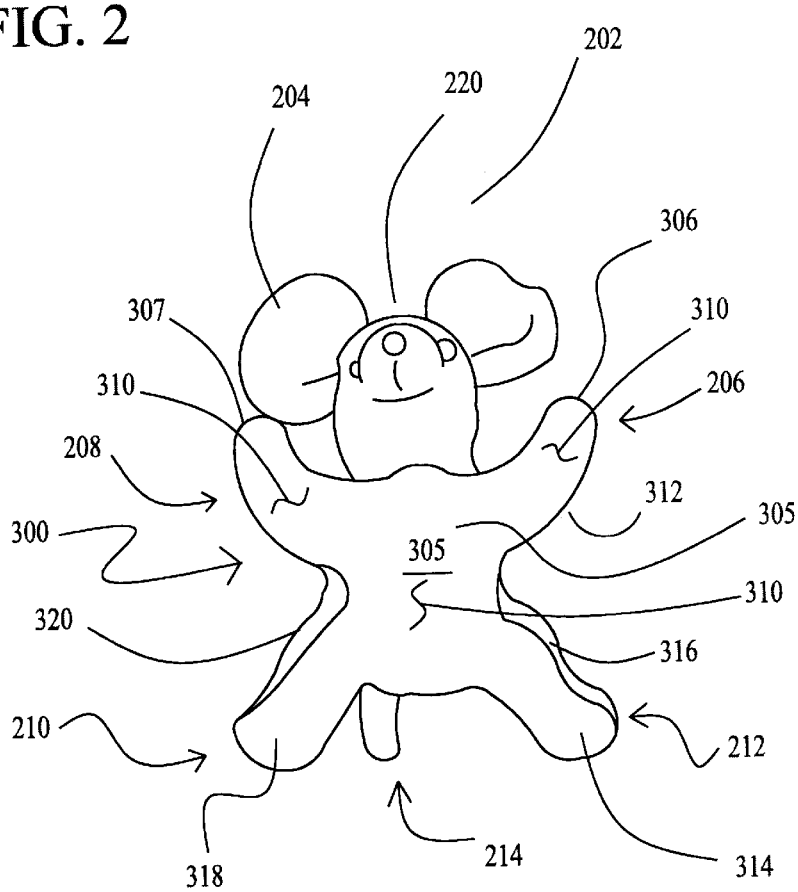

DISPLAY SCREEN CLEANING TOOL

FIELD OF THE INVENTION

The present invention relates generally to cleaning tools for electronic display screens, and more specifically to cleaning tools for computer display screens and the like.

BACKGROUND OF THE INVENTION

Computer monitors, and more generally, electronic display screens, are in wide use as a result of the "boom" in the quantity of personal computers for both business and home use. Such display screens include both those which commonly have a glass surface, or the flat panel display screens commonly employed with laptop computers which are plastic-like or other materials for providing the display's active matrix screens and the like. Commonly, such display screens generally have an optical grade surface for providing minimally distorted visual information.

These display screens (i.e., the monitor) generally act as a collector for dust particles, as well as being marred by touching the display screen by the user or on-lookers. This is of course necessitates the need for cleaning the display screen without any degradation of the surface of the display screen resulting from cleaning or wiping the screen with a cleaning tool, such as a common rag. The same is true for television display screens, since both are generally made from glass. However, advancements in the art of computer monitors have made them increasingly more vulnerable to improper maintenance, since they are constructed so as to minimize glare and therefore of different construction than common TV monitors.

Employment of a non-optical grade "wiping rag" material for wiping a display screen may have deleterious effects upon the display screen—i.e., marring or scratching the surface. This is so since common cleaning "rags" of differing materials may be too abrasive and cause damage to the display screen. Handkerchiefs, scrap cloth from wash and wear fabrics and the like, used for wiping a display screen may scratch or be harmful to the display screen since such materials are commonly made from synthetic fibers which may have abrasive properties deleterious to the optical grade display screen.

Thus, there is a need for a cleaning tool for cleaning display screens which is safe for cleaning or wiping the display screen while minimizing any display screen degradation resulting from the wiping of the screen therewith. Of course, the screen could be cleaned with optical lens paper cleaners. However, use of such cleaners on large monitors is impractical, as well as very costly. Furthermore, such materials may contain wood particles which may be harmful to the optical grade display screens with repeated use for cleaning and wiping the display screen.

As a second consideration, it is desired to have a display screen cleaning tool which is conveniently accessible, particularly for computer monitors, and which is pleasant to the eye as it sits on a desk or the like, or the monitor itself.

SUMMARY OF THE INVENTION

An object of the present invention is to provide a display screen cleaning tool, which minimizes any degradation to the display screen surface as a result of wiping the screen.

Another object of the present invention is to provide a display screen cleaning tool, which is pleasant to the eye and easily, manufactured.

In accordance with the present invention, an optical grade chamois like fabric is employed as a display screen cleaning tool. In one embodiment of the invention, an optical grade chamois like fabric is utilized, at least in part, to form a body having an inner chamber capable of being filled with a stuffing material so as to form a three dimensional doll-like figure, and an outer surface for wiping the display screen. In the preferred embodiment of the invention, the three dimensional doll-like figure is a soft bellied figure of an animal or the like where the belly of the figure is comprised of chamois. In another embodiment of the invention, the display screen cleaning tool is embodied in a pocket style configuration for permitting the insertion of fingers therein to facilitate the cleaning tool.

BRIEF DESCRIPTION OF THE DRAWINGS

FIG. 2 is an exemplary representation of a three dimensional stuffed doll-like figure siting on a computer monitor.

FIG. 3 is a plan view of the stuffed doll-like figure of FIG. 2.

DETAILED DESCRIPTION OF THE INVENTION

Figures 1A, 1B, 1C:
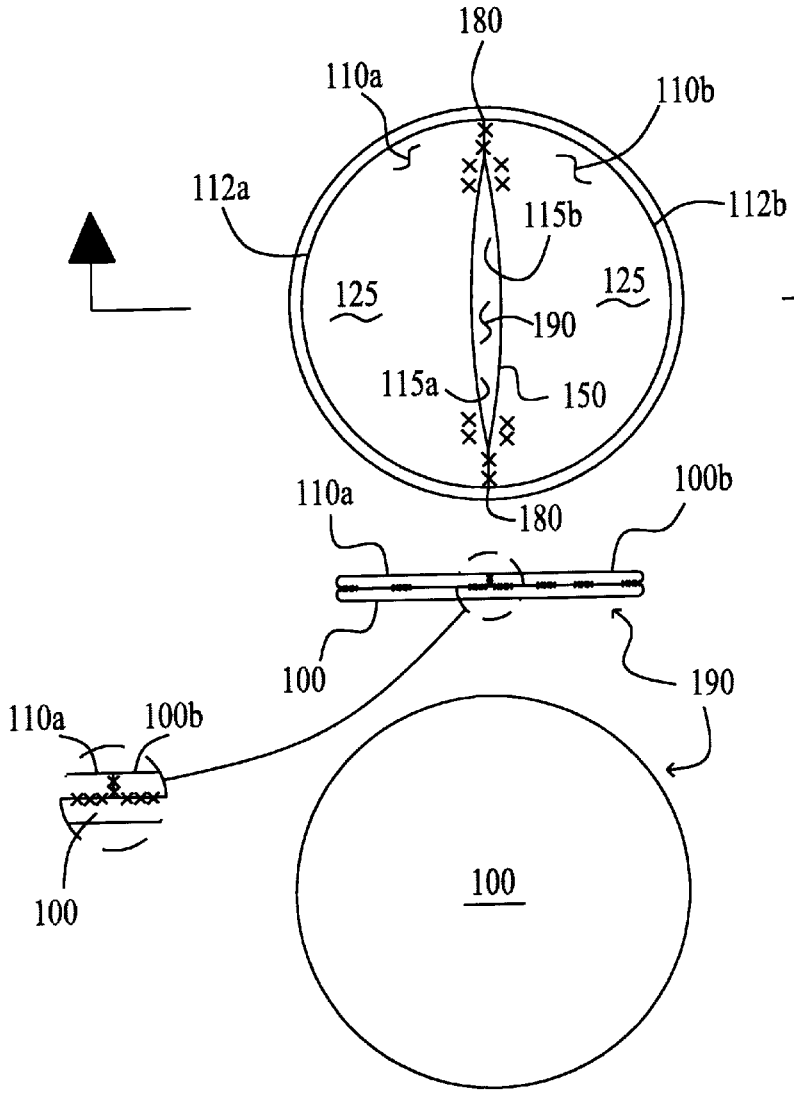
FIGS. 1*a,* 1*b,* and 1*c* are plan views of a display screen cleaning tool embodied in a pocket style configuration.

Illustrated in FIGS. 1*a,* 1*b,* and 1*c* are differing plan views of a display screen cleaning tool embodied in a pocket style configuration in accordance with the present invention. FIG. 1*a* illustrates a generally disc-shaped strip or piece of fabric material 100. FIGS. 1*b* and 1*c* illustrate an assemblage of semi-circular strips of fabric material 110*a* and 110*b* so as to form a general disc-shape of material generally indicated by numeral 125 opposite circular strip 100. Strips 110*a* and 110*b* include a semicircular arcuate edge 112*a* and 112*b,* and straight edge 115*a* and 115*b,* respectively along the diameter thereof.

The circumferential edge of strip 100 and the arcuate edges 112*a* and 112*b* of strips 110 and 120 are seamed together so as to generally form a disc-shaped body 190 having an inner chamber or pocket comprised of opposing disc-shaped strip 100 and the pair of semicircular-shaped strips 110*a* and 110*b* so that straight edges 115*a* and 115*b* are aligned with each other in a relaxed condition. Strips 110*a* and 110*b* include edge stitching or seaming, generally indicated by the letter "x" in the drawing, as is common practice for hiding the rough edges of fabric strips as is well known in the art of sewing.

In accordance with the present invention, strips 110*a* and 110*b* are sewed together, in part, near the juncture of the circumferential edge of strip 100 and the arcuate and straight line edge common points of the semi-circular strips, generally indicated by numeral 180, so as create a pocket access generally along the straight line edge or diameter of the semi-circular strips as is generally indicated by numeral 190 in FIG. 1*c*. Portions of the straight edge of strips 110*a* and 110*b* may be sewn together as is generally indicated by the letter "X," at or around the peripheral portions of the strips so as to strengthen the pocket and provide an aesthetically pleasing and tailored disc-shaped body 190. In the preferred embodiment of the invention, strip 100 is a fabric material known simply as chamois as will be subsequently described. Strips 110*a* and 110*b* may be like material or differing materials and colors as desired. The diameter of the disc shaped body is intended to be equal or like that of a conventional compact disc, and of thickness to be able to fit within a conventional compact disc plastic package or case, not shown.

Illustrated in FIG. 2 is an exemplary representation of a three dimensional stuffed doll-like figure 200, in accordance with the present invention, siting on a computer monitor 210 having a display screen 210. FIG. 3 is a plan view of the doll-like figure 200 illustrating the display screening tool of the present invention.

Referring to FIGS. 2 and 3, the exemplary doll-like figure 200 is in the shape of a mouse having many body members including ears 202 and 204, legs 206, 208, 210, and 212, tail 214, and head 220. The doll-like figure 200 is constructed from a plurality of strips of fabric material so to create a three-dimensional mouse like figure. The assemblage of strips are sewn together in accordance with stuff or under-stuffed toy sewing techniques well known in the art so as to form one or more chambers or pockets for containing stuffing material. The assemblage may be constructed in a manner in which only one chamber is created so a to contain stuffing material. Alternatively, the doll-like figure may be constructed to have several different chambers so as to hold either the same or differing stuffing material. Preferably, one of the chambers of the doll-like figure which includes an outer surface of chamois-like material may be "under-stuffed" in a manner in the art of "under-stuffed" doll-like figures, e.g., "Beanie Babies."

For example, the head 220 may be filled with cotton or polyester fiber. The ears may be empty chambers or simply a single layer of material. The main body or torso and legs may be filled with a "bean like" substance, either alone or in combination with a soft material, to provide differing feel to the touch as desired. In the preferred embodiment of the invention, the doll-like figure is preferably includes some "bean-like material so as to have sufficient weight to stay in position on a ledge or the like of office type equipment, and more specifically a computer monitor as illustrated in FIG. 2.

Referring again to FIG. 3, the doll-like figure includes a main body, generally indicated by numeral 300. The main body 300 is shown constructed from two strips of fabric material, indicated by numerals 310 and 312, sewn together to form an inner chamber or cavity, not shown, for containing stuffing material. Main body 300 is illustrated to include the "belly" portion 305, including bottom leg appendages 306 and 307, of the doll-like figure 200. Leg 210 may also be constructed from two strips of fabric material, indicated by numerals 318 and 320, sewn together to form an inner chamber not shown; and leg 212 may also be constructed from two strips of fabric material, indicated by numerals 314 and 316, sewn together to form an inner chamber not shown. Each of the aforementioned inner chambers are filled with a selected stuffing material as described previously for the desired effect or feeling, and to give the body parts the three dimensional characteristic. It should be noted that the bottom leg appendages identified by strips of fabric material 314 and 318 may be integral with material strip 310.

In the preferred embodiment of the present invention, at least one of the strips of material that forms any part of the doll-like figure outer surface is chamois fabric material as will be subsequently described. For the exemplary doll-like figure 200 of a mouse illustrated in FIG. 3, only fabric strip 310 may be chamois fabric. Alternatively, other body parts may be chamois fabric, for example strips 314 and 318, which form in part legs 210 and 212. Of course, the entire doll-like figure may be made entirely of chamois fabric material.

In the preferred embodiment of the invention, the three dimensional doll-like figure, e.g., the mouse like figure illustrated in FIGS. 2 and 3, is a soft bellied figure of an animal or the like where the belly of the figure is chamois. Referring to FIG. 3, preferably a single strip or piece of fabric material 310 of the doll-like figure 200 forms the underside belly 305 of the doll-like figure 200, in addition to all of the leg appendages 206, 208, 210, and 212—i.e., strip 310 is preferably integral with strips 316 and 318 thereby forming the underside of all of the leg appendages.

To further illustrate the preferred embodiment of the innovation, a porpoise figure (not shown) may be comprised of two strips or pieces of fabric—a chamois strip for the underside or belly of the porpoise, and another strip of material completing the doll-like figure. In turn, these are sewn together to form a chamber for containing a selected stuffing material—preferably to be under-stuffed. Of course, the reverse may be true. Also, if desired the entire porpoise may be made of strips of optical grade chamois.

Chamois-like fabric material is well known in the art, and it has many applications as a highly absorbent material as particularly described in U.S. Pat. No. 5,687,445, entitled "Lens Wipe," issued to Hocking. Hocking teaches the use of a lens wiping material made from sheepskin or lambskin, split before tanning. The material is intended to be tanned so as to produce a soft absorbent material for removal of wetness from eyewear. A companion application of a chamois, as is well known, is its use as a final wiping stage of an automobile after a car wash because of its highly absorbent characteristic that minimizes any streaking left after wiping.

Another application of chamois is taught in U.S. Pat. No. 5,201,093, entitled, "Video Game Console and Cartridge Cleaning Kit," issued to Wells. A chamois fabric material is used, in part, as a wand cover, for absorbing a cleaning fluid for cleaning electrical contacts associated with video game electronic components.

Of course, since chamois fabric material is leather, it may be formed or sewed into any desired shape like any other leather. An example of the latter is illustrated in U.S. Pat. No. 5,074,249, entitled, "Toy and Method for Making the Toy," issued to McMahon. This patent teaches use of a chamois material as the basis of a toy for a cat. The chamois is simply rolled to form a log like roll and modified to create a mouse like effect.

Before proceeding, it should be understood, as used herein, that "chamois" is intended to refer to any leather—i.e., an animal skin dressed for use. In the preferred embodiments of the invention, "chamois" is intended to mean skin from a chamois (goat like antelope) or sheepskin. However, other animal skin products, which have the intended characteristics, are intended to be within the meaning of chamois as used in accordance with the preferred embodiment of the present invention.

In accordance with the present invention, it has been discovered that a chamois skin, or the like, may be dressed in accordance with a specified dressing process to yield an optical grade chamois fabric material. In the preferred embodiment of the invention, optical grade chamois is obtained from Hutchings & Harding LDT, Sawston, Cambridge CB2 4HN England, which was established in 1897. Hutchings & Harding LDT produces a chamois fabric material specified as "CLUT" which is prepared by the Manufacturer's secret process, and is believed to include double brushing or buffing of the animal skin. Further, the skin is tanned in fish oil, and more specifically cod oil.

It was found that the aforementioned chamois, produced by the Hutchings & Harding LDT, company may be utilized as an optical grade cleaning fabric which has excellent properties for cleaning optical grade display screen surfaces, including, but not limited to, computer monitor display screens, flat panel laptop computer display screens, television screens, and the like. Application of the aforementioned optical grade chamois for wiping and cleaning such screens permits cleaning of the display screen with minimal degradation, if any, of the optical qualities of the display screen.

In accordance with the preferred method of the present invention, a large cloth of the chamois fabric material, e.g. 6 square feet, is first inspected for quality by an independent chamois inspection service, e.g., SGS, United Kingdom LTD. In turn the received material after the preliminary inspection is visually inspected for imperfections, i.e. rough surfaces and loss of buffed, uneven grain, and/or soft material. This process is to identify those portions of the incoming chamois material that has uniform strength and consistency of surface so as to be considered an optical grade chamois fabric having a minimal degrading effect, if any, upon the optical grade display screen due to wiping of the display screen surface with the optical grade chamois.

From the remainder of the fabric, excluding the imperfections, pieces of the chamois fabric material is utilized for the optical grade chamois fabric employed in the display screen cleaning tool of the present invention, and more specifically to the bellies of the aforementioned doll-like figures.

As illustrated above, in one embodiment of the present invention the optical grade chamois fabric material is configured or constructed so as to serve as a body part of a selected three-dimensional figure which forms an outer surface of the three-dimensional figure, and in turn serve as a display screen cleaning tool. In another embodiment of the present invention the optical grade chamois fabric material is configured so as to form a disc-shaped structure with an opening for the insertion of fingers to facilitate the cleaning of a display screen.

It should be noted that the stuffing material may be chosen from a wide variety of materials, including, but not limited to cotton, polyester fiber, and bean like material. The material is intended to provide a pliant three-dimensional shape that may hang over or sit/lay on ledges and the like—e.g., a computer monitor.

It should be noted that the stuffed doll-like figure as illustrated in FIG. 1 may take on any desired three-dimensional configuration extending from animals, birds, an including inanimate objects such as a computer terminal as illustrated in U.S. Pat. No. 5,647,786, entitled, "Stuffed Personal Computer Toy. The doll-like figure may be constructed by attaching several bodies together by sewing and/or "hook and loop" fastener materials, such as Velcro™. The stuffed doll-like figure may either be first constructed of several different material pieces sewed together and then stuffed, thereby exhibiting several different body portions, or may alternatively be several different bodies sewed together or attached or fastened together. It should be obvious to those skilled the art that there is a wide range of manufacturing techniques in the construction of the doll-like figure(s) in accordance with the present invention.

As indicated earlier, the optical grade chamois-like may be provided by truly chamois animal skins or other animal skins, as well a other materials other than animal skins which have the intended properties. The quality of the chamois like material is of course a matter of economics and performance benefits.

While the present invention has been particularly shown and described with reference to the accompanying figures, it will be understood, however, that other modifications thereto are of course possible, all of which are intended to be within the true spirit and scope of the present invention. Various changes in form and detail may be made therein without departing from the true spirit and scope of the invention as defined by the appended claims.

We claim:

1. A method of making a three-dimension soft display screen cleaning tool for cleaning the surface of a display screen comprising the steps of:

assembling one or more strips of a fabric material to form a selected doll-like figure body including outer body surface portions and at least one inner chamber, wherein one of said strips forms, in part, said inner chamber, and is composed of a soft pliant fabric having substantially optical-grade non-abrasive characteristics;

filling said at least one inner chamber with a selected quantity of stuffing material so as to provide said doll-like figure body, at least in part, with a three dimensional shape, which may be utilized as a pliant cleaning tool for wiping a display screen; and sealing said at least one inner chamber so as to retain said stuffing material within said body.

2. The method of claim 1 wherein said soft pliant fabric is leather processed so as to have optical grade abrasive characteristics so as to minimize any degradation of the surface of a display screen resulting from cleaning or wiping said screen with said display screen cleaning tool.

3. The method of claim 2 wherein said soft pliant fabric is chamois.

4. The method of claim 1 wherein said soft pliant fabric is synthetic chamois fabric.

5. The method of claim 1 wherein more than one of said one or more strips of a fabric material are assembled together by sewing.

6. A three-dimensional doll-like figure for cleaning or wiping the surface of a display screen comprising:

a plurality of strips of fabric material sewed together so as to form a doll-like figure body having outer surface portions and at least one inner chamber, and wherein at least one of said plurality of strips of fabric material forms, in part, said inner chamber, and is composed of an optical grade fabric having substantially non-abrasive characteristics with regard to display screen surfaces; and a selected quantity of stuffing material within said at least one inner chamber so as to provide said doll-like figure with a three dimensional shape which is squeezable for providing a pliant cleaning tool for wiping a display screen.

7. The doll-like figure of claim 6 wherein said optical grade fabric is leather processed so as to have optical grade abrasive characteristics so as to minimize any degradation of the surface of a display screen resulting from cleaning or wiping said screen with said display screen cleaning tool.

8. The doll-like figure of claim 6 wherein said optical grade fabric is a leather fabric processed so as to have optical grade abrasive characteristics so as to minimize any degradation of the surface of a display screen resulting from cleaning or wiping said screen with said display screen cleaning tool.

9. The doll-like figure of claim 6 wherein said optical grade fabric is chamois.

10. The doll-like figure of claim 6 wherein more than one of said plurality of strips of a fabric material are assembled together by sewing.

11. A soft-bellied under-stuffed doll-like figure for cleaning or wiping the surface of a display screen comprising:

strips of fabric material sewed together so as to form a doll-like figure body having an outer surface portions and at least one inner chamber, and wherein at least one of said strips of fabric material forms, in part, said inner chamber, and forming the underside belly of said soft-bellied under-stuffed doll-like figure, and which is composed of an optical grade fabric having substantially non-abrasive characteristics; and a selected quantity of stuffing material within said at least one inner chamber so as to provide said doll-like figure with a three dimensional shape which is squeezable for providing a pliant cleaning tool for wiping a display screen.

12. The soft-bellied under-stuffed doll-like figure of claim 11 wherein said optical grade fabric is leather processed so as to have substantially optical grade abrasive characteristics so as to minimize any degradation of the surface of a display screen resulting from cleaning or wiping said screen with said underside belly.

13. The doll-like figure of claim 12 wherein said optical grade fabric is chamois.

14. The soft-bellied under-stuffed doll-like figure of claim 11 wherein said optical grade fabric is synthetic chamois fabric processed so as to have optical grade abrasive characteristics so as to minimize any degradation of the surface of a display screen resulting from cleaning or wiping said screen with said underside belly.

* * * * *

US006195831C1

(12) EX PARTE REEXAMINATION CERTIFICATE (7094th)

United States Patent

Devaney et al.

(10) Number: US 6,195,831 C1

(45) Certificate Issued: Oct. 6, 2009

(54) DISPLAY SCREEN CLEANING TOOL

(76) Inventors: Thomas W. Devaney, 2219 W. Olive, Suite #148, Burbank, CA (US) 91506; Stephen M. Plakey, 11900 Goshen Ave., Suite #104, Los Angeles, CA (US) 90049

Reexamination Request:
No. 90/006,224, Feb. 15, 2002

Reexamination Certificate for:

| | |
|---|---|
| Patent No.: | **6,195,831** |
| Issued: | **Mar. 6, 2001** |
| Appl. No.: | **09/185,994** |
| Filed: | **Nov. 4, 1998** |

(51) Int. Cl.
*A47L 25/00* (2006.01)

(52) U.S. Cl. ..... 15/209.1; 15/118; 15/210.1; 15/227; D32/43

(58) Field of Classification Search ..... None
See application file for complete search history.

(56) References Cited

U.S. PATENT DOCUMENTS

| | | | | |
|---|---|---|---|---|
| 1,681,031 | A | * | 8/1928 | Forbis |
| 2,117,962 | A | * | 5/1938 | Johnson |
| D170,734 | S | * | 10/1953 | Wright |
| 2,756,448 | A | * | 7/1956 | Werbe |
| 2,997,810 | A | * | 8/1961 | Bellas ..... 446/369 |
| 3,616,175 | A | * | 10/1971 | Jung |
| 5,000,204 | A | * | 3/1991 | Smith |
| 5,074,249 | A | * | 12/1991 | McMahon |
| 5,201,093 | A | | 4/1993 | Wells et al. |
| 5,280,661 | A | * | 1/1994 | Brown |
| 5,344,002 | A | * | 9/1994 | Baczkowski |
| 5,647,786 | A | | 7/1997 | Caspescha |
| 5,657,507 | A | | 8/1997 | Wasak |
| 5,687,445 | A | | 11/1997 | Hocking |
| 5,694,659 | A | * | 12/1997 | Merrion |
| 5,746,639 | A | | 5/1998 | Bloom et al. |
| 5,915,434 | A | * | 6/1999 | Juarez |

FOREIGN PATENT DOCUMENTS

| | | | |
|---|---|---|---|
| GB | 0011063 | * | 1/1916 |

OTHER PUBLICATIONS

A prior printed publication entitled "Viking® Office Products Discount Buyers Guide®" for "Fall 1996".
A prior printed publication entitled "Viking® Office Products Discount Buyers Guide®" for "Spring 1997".
A prior printed publication entitled "Collector's Value Guide™" for "Ty® Beanie Babies®" by CheckerBee Publishing.
Product Brochure: Hutchings & Harding LDT Date Unknown.
SGS Certificate of Inspection Mar. 31, 1998.

* cited by examiner

*Primary Examiner*—Jerry D. Johnson

(57) ABSTRACT

An optical grade chamois like fabric is employed as a display screen cleaning tool. In one embodiment of the invention, an optical grade chamois like fabric is utilized, at least in part, to form a body having an inner chamber capable of being filled with a stuffing material so as to form a three dimensional figure, and an outer surface for wiping the display screen. In another embodiment of the invention, the display screen cleaning tool is embodied in a pocket style configuration for permitting the insertion of fingers therein to facilitate the cleaning tool.

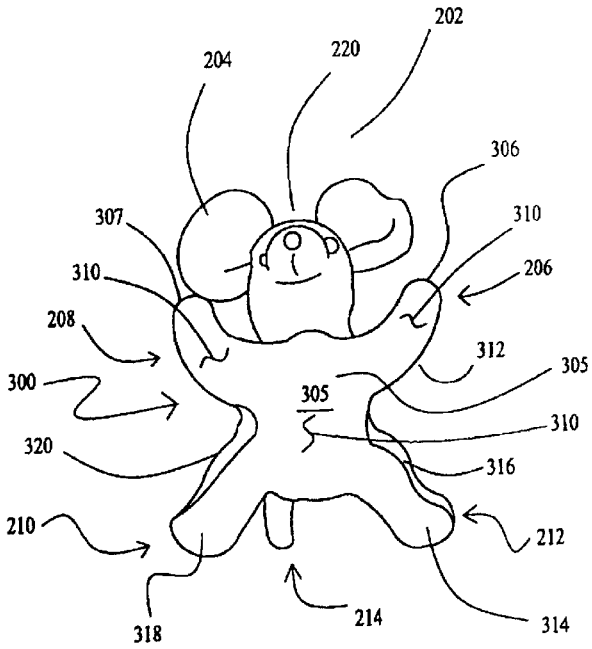

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–14 are cancelled.

New claims 15 and 16 are added and determined to be patentable.

*15. The doll-like figure of claim 6 wherein another of said strips of fabric material is a nonoptical grade fabric material.*

*16. The doll-like figure of claim 11 wherein another of said strips of fabric material is a nonoptical grade fabric material.*

* * * * *